US009797654B2

(12) United States Patent
Kirchner et al.

(10) Patent No.: US 9,797,654 B2
(45) Date of Patent: Oct. 24, 2017

(54) METHOD AND DEVICE FOR OXYGEN PRODUCTION BY LOW-TEMPERATURE SEPARATION OF AIR AT VARIABLE ENERGY CONSUMPTION

(71) Applicants: Lars Kirchner, Dresden (DE); Dimitri Goloubev, Munich (DE)

(72) Inventors: Lars Kirchner, Dresden (DE); Dimitri Goloubev, Munich (DE)

(73) Assignee: Linde Aktiengesellschaft, Munich (DE)

( * ) Notice: Subject to any disclaimer, the term of this patent is extended or adjusted under 35 U.S.C. 154(b) by 181 days.

(21) Appl. No.: 14/899,031

(22) PCT Filed: Jul. 10, 2014

(86) PCT No.: PCT/EP2014/001892

§ 371 (c)(1),
(2) Date: Dec. 16, 2015

(87) PCT Pub. No.: WO2015/003809

PCT Pub. Date: Jan. 15, 2015

(65) Prior Publication Data

US 2016/0123662 A1 May 5, 2016

(30) Foreign Application Priority Data

Jul. 11, 2013 (EP) ..... 13003509

(51) Int. Cl.
*F25J 3/00* (2006.01)
*F25J 3/04* (2006.01)
*F25J 3/06* (2006.01)

(52) U.S. Cl.
CPC ..... *F25J 3/04836* (2013.01); *F25J 3/0406* (2013.01); *F25J 3/0409* (2013.01); (Continued)

(58) Field of Classification Search
CPC ..... F25J 3/04812; F25J 3/0483; F25J 3/0486; F25J 3/04496; F25J 3/04018; (Continued)

(56) References Cited

U.S. PATENT DOCUMENTS 5,006,139 A * 4/1991 Agrawal ..... F25J 3/0406 62/646
2005/0132746 A1 6/2005 Brugerolle et al.
2008/0115531 A1* 5/2008 Ha ..... F25J 3/0406 62/620

FOREIGN PATENT DOCUMENTS

FR 2 930 331 A1 10/2009
WO WO 2009/136077 A2 11/2009

OTHER PUBLICATIONS

Jean-Pierre Tranier et al., Air Separation, flue gas compression and purification units for oxy-coal combustion systems, Energy Procedia 4 (2011) pp. 966-971, Elsevier.

* cited by examiner

*Primary Examiner* — Keith Raymond
(74) *Attorney, Agent, or Firm* — Philip H. Von Neida

(57) ABSTRACT

A method and device to produce oxygen by the low-temperature separation of air at variable energy consumption. A distillation column system comprises a high-pressure column, a low-pressure column and a main condenser, a secondary condenser and a supplementary condenser. Gaseous nitrogen from the high-pressure column is liquefied in the main condenser in indirect heat exchange with an intermediate liquid from the low-pressure column. A first liquid oxygen stream from the bottom of the low-pressure column is evaporated in the secondary condenser in indirect heat exchange with feed air to obtain a gaseous oxygen product. The supplementary condenser serves as a bottom heating device for the low-pressure column and is heated by means of a first nitrogen stream from the distillation column system, which nitrogen stream was compressed previously in a cold compressor.

11 Claims, 4 Drawing Sheets

(52) U.S. Cl.
CPC ..... *F25J 3/04018* (2013.01); *F25J 3/04024* (2013.01); *F25J 3/0426* (2013.01); *F25J 3/0483* (2013.01); *F25J 3/0486* (2013.01); *F25J 3/04157* (2013.01); *F25J 3/04169* (2013.01); *F25J 3/04181* (2013.01); *F25J 3/04206* (2013.01); *F25J 3/04218* (2013.01); *F25J 3/04309* (2013.01); *F25J 3/04351* (2013.01); *F25J 3/04412* (2013.01); *F25J 3/04418* (2013.01); *F25J 3/04424* (2013.01); *F25J 3/04496* (2013.01); *F25J 3/04581* (2013.01); *F25J 3/04618* (2013.01); *F25J 3/04812* (2013.01); *F25J 3/04878* (2013.01); *F25J 3/04884* (2013.01); *F25J 3/04957* (2013.01); *F25J 3/0605* (2013.01); *F25J 3/066* (2013.01); *F25J 2200/06* (2013.01); *F25J 2200/54* (2013.01); *F25J 2205/32* (2013.01); *F25J 2205/34* (2013.01); *F25J 2205/62* (2013.01); *F25J 2205/70* (2013.01); *F25J 2210/50* (2013.01); *F25J 2230/04* (2013.01); *F25J 2230/24* (2013.01); *F25J 2230/30* (2013.01); *F25J 2230/42* (2013.01); *F25J 2235/52* (2013.01); *F25J 2240/70* (2013.01); *F25J 2250/04* (2013.01); *F25J 2250/40* (2013.01); *F25J 2250/50* (2013.01)

(58) Field of Classification Search
CPC .. F25J 3/04024; F25J 3/04157; F25J 3/04412; F25J 3/04418; F25J 3/0406; F25J 3/0409; F25J 3/04169; F25J 3/04181; F25J 3/04206; F25J 3/04218; F25J 3/0426; F25J 3/04309; F25J 3/04351; F25J 3/04581; F25J 3/04618; F25J 3/04878; F25J 3/04884; F25J 3/04957; F25J 3/04424; F25J 3/0605; F25J 3/066; F25J 2200/54; F25J 2200/06; F25J 2205/32; F25J 2205/34; F25J 2210/50; F25J 2230/04; F25J 2230/30; F25J 2230/24; F25J 2230/42; F25J 2235/52; F25J 2240/70; F25J 2250/04; F25J 2250/40; F25J 2250/50
See application file for complete search history.

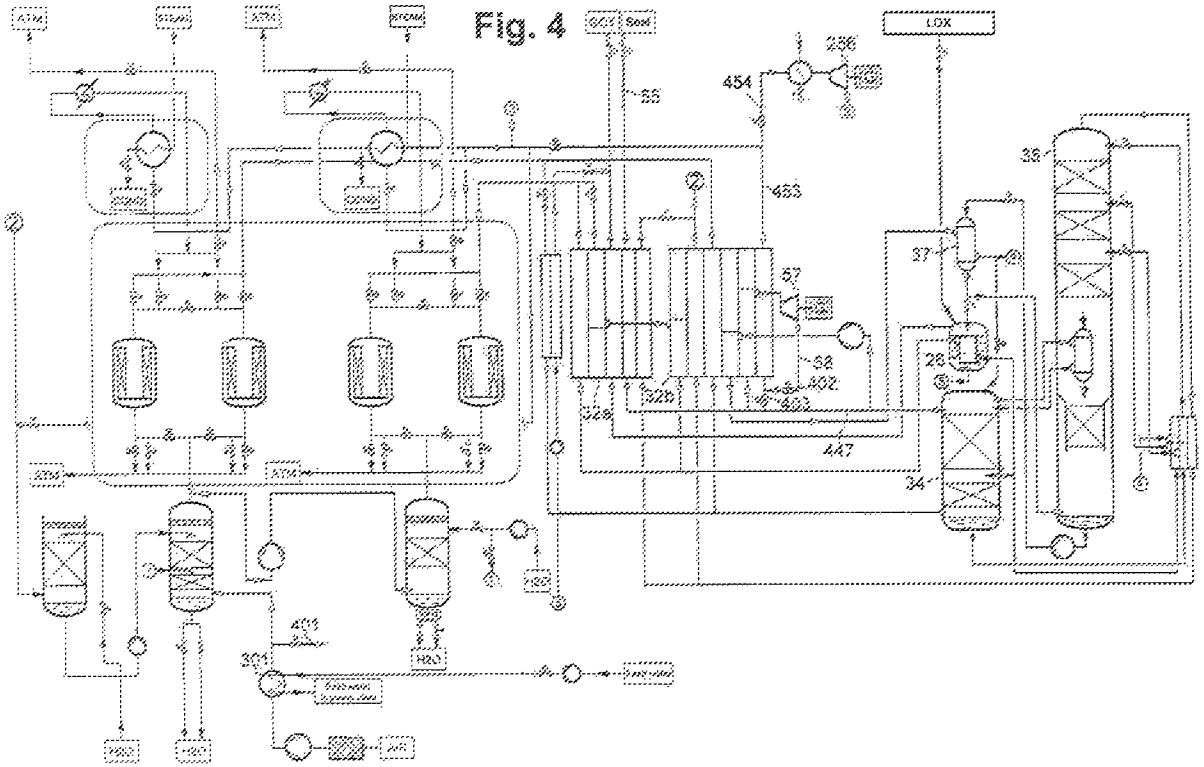
LOX
38
37
28
34
236
454
463
67
58
402
403
447
326
65
Sand
Gel
Fuel
Fuel
Fu

METHOD AND DEVICE FOR OXYGEN PRODUCTION BY LOW-TEMPERATURE SEPARATION OF AIR AT VARIABLE ENERGY CONSUMPTION

CROSS-REFERENCE TO RELATED APPLICATIONS

This application claims priority under 35 USC §119 to International Patent Application No. PCT/EP2014/001892, filed on Jul. 10, 2014, which claims priority from European Patent Application EP 13 003 510.8 filed on Jul. 11, 2013.

BACKGROUND OF THE INVENTION

The invention relates to a method for oxygen production by low-temperature separation of air with variable energy consumption in a distillation column system having a high-pressure column, a low-pressure column as well as a main condenser and a side condenser which are both in the form of condenser-evaporators, wherein in the method

- atmospheric air is compressed to a total air pressure in a main air compressor, cooled in a main heat exchanger and fed at least in part to the high-pressure column,
- in the main condenser, gaseous nitrogen from the high-pressure column is at least partially liquefied,
- at least a portion of the liquid nitrogen generated in the main condenser is used as reflux in at least one of the columns of the distillation column system,
- a first liquid oxygen stream from the bottom of the low-pressure column is introduced into the side condenser and is at least partially evaporated therein in indirect heat exchange with at least a portion of the compressed and cooled feed air,
- at least a portion of the evaporated first liquid oxygen stream is obtained as a gaseous oxygen product,
- in a first operating mode with higher energy consumption
- a first amount of the first liquid oxygen stream from the bottom of the low-pressure column is introduced into the side condenser and
- a first amount of air is compressed in the main air compressor to a first outlet pressure, in a second operating mode

- a second amount of air, which is smaller than the first amount of air, is compressed in the main air compressor,
- a second amount of the first liquid oxygen stream from the bottom of the low-pressure column, which is smaller than the first amount, is introduced into the side condenser, and
- a second liquid oxygen stream is fed to the side condenser in addition to the first liquid oxygen stream. The method and the device of the invention are suitable in particular for producing gaseous impure oxygen. "Impure oxygen" is here understood as being a product having a purity of less than 98 mol. %.

Methods and devices for the low-temperature separation of air are known, for example, from Hausen/Linde, Tieftemperaturtechnik, 2nd Edition, 1985, Chapter 4 (pages 281 to 337).

The distillation column system can be in the form of a two-column system (for example in the form of a conventional Linde double column system) or alternatively in the form of a system having three or more columns. In addition to the columns for nitrogen-oxygen separation, it can have further devices for producing highly pure products and/or other air components, in particular noble gases, for example for argon production and/or krypton-xenon production.

The "low-pressure column" is here understood as being a uniform distillation region in which the pressure is constant apart from the natural pressure loss at the material exchange elements. This distillation region can be arranged in one or more containers.

The "main heat exchanger" serves to cool feed air in indirect heat exchange with return streams from the distillation column system. It can be formed of a single heat exchanger section or of a plurality of heat exchanger sections connected in parallel and/or in series, for example of one or more plate heat exchanger blocks.

"Condenser-evaporator" refers to a heat exchanger in which a first, condensing fluid stream comes into indirect heat exchange with a second, evaporating fluid stream. Each condenser-evaporator has a liquefaction space and an evaporation space, which consist of liquefaction passages and evaporation passages, respectively. In the liquefaction space, the condensation (liquefaction) of a first fluid stream is carried out; in the evaporation space, the evaporation of a second fluid stream is carried out. The evaporation and liquefaction spaces are formed by groups of passages which are in heat exchange relationship with one another.

A "side condenser" is to be understood as being a condenser-evaporator which is designed almost exclusively for the indirect transfer of latent heat from a condensing process stream evaporation to an evaporating process stream against a second, condensing process stream and is not or substantially not suitable for the transfer of sensible heat. It is formed by a heat exchanger which is separate from other heat exchangers, in particular a main heat exchanger or a supercooling countercurrent heat exchanger, both of which generally serve solely or predominantly for the heat exchange of purely gaseous streams.

"Amounts" of streams here refer to the mass flow rate, measured, for example, in $Nm^3/h$.

In this application, process parameters such as mass streams or pressures are repeatedly described which are "smaller" or "larger" in one operating mode than in another operating mode. This means purposive changes of the corresponding parameter by regulating and/or control devices and not natural variations within a steady-state operating state. These purposive changes can be effected directly by adjusting the parameter itself or indirectly by adjusting other parameters which influence the parameter to be changed. In particular, a parameter is "larger" or "smaller" when the difference between the mean values of the parameter in the different operating modes is more than 2%, in particular more than 5%, in particular more than 10%.

The "first liquid oxygen stream" is the mass stream of liquid oxygen that is removed from the low-pressure column and introduced into the evaporation space of the side condenser. It can be the total amount of the liquid oxygen removed from the low-pressure column. The first liquid oxygen stream can, however, also consist of only a portion of the liquid oxygen removed from the low-pressure column, for example when a liquid oxygen product is additionally obtained from the low-pressure column and fed to a liquid tank. If a liquid oxygen product is drawn from the evaporation space of the side condenser, it is generally formed by a portion of the "first liquid oxygen stream". Conversely, liquid oxygen additional to the first liquid oxygen stream can in principle be fed to the side condenser.

The "second liquid oxygen stream" represents the difference between the total amount of liquid oxygen introduced into the evaporation space of the side condenser and the first liquid oxygen stream. The second liquid oxygen stream is removed from a liquid tank, for example. The liquid tank can be filled solely from an external source, solely with liquid oxygen from the low-pressure column (as in Springmann, see below), or partly with external liquid oxygen and partly with liquid oxygen formed in the distillation column system, in particular in the low-pressure column or in the evaporation space of the side condenser.

A method of the type mentioned at the beginning and a corresponding device are known from Springmann, "Energieeinsparung", Linde-Symposium "Luftzerlegungs-anlagen", 4th seminar of Linde AG of Oct. 15-17, 1980, Article H. An alternative reservoir process with two liquid tanks is shown therein. However, that process is carried out not with a constant throughput through the distillation column system with a varying product amount, but with varying operation in dependence on varying energy costs. When the energy price is low, oxygen is produced for stock and stored in a liquid tank. When the energy price is high, the amount of air is reduced and a portion of the oxygen product is removed from the stock. The separative work performed on the stored oxygen is thus available for energy storage. According to this teaching, in times of cheap energy the liquid air is replaced with liquid oxygen in the plant, that is to say liquid oxygen is fed into the tank and the equivalent amount of liquid air is fed from the corresponding tank into the distillation column system. Conversely, in times of high electricity prices, liquid oxygen from the tank is fed into the system and liquid air is stored. Accordingly, virtually only the stored oxygen molecules are available for energy storage; in times of high electricity prices, the main air compressor has to deliver correspondingly less separation air.

The object underlying the invention is to improve the efficiency of such a method in terms of energy storage.

SUMMARY OF THE INVENTION

This object is achieved by a method for oxygen production by low-temperature separation of air with variable energy consumption in a distillation column system having a high-pressure column, a low-pressure column as well as a main condenser and a side condenser which are both in the form of condenser-evaporators, wherein in the method atmospheric air is compressed to a total air pressure in a main air compressor, cooled in a main heat exchanger and fed at least in part to the high-pressure column, in the main condenser, gaseous nitrogen from the high-pressure column is at least partially liquefied, at least a portion of the liquid nitrogen generated in the main condenser is used as reflux in at least one of the columns of the distillation column system, a first liquid oxygen stream from the bottom of the low-pressure column is introduced into the side condenser and is at least partially evaporated therein in indirect heat exchange with at least a portion of the compressed and cooled feed air, at least a portion of the evaporated first liquid oxygen stream is obtained as a gaseous oxygen product, in a first operating mode with higher energy consumption a first amount of the first liquid oxygen stream from the bottom of the low-pressure column is introduced into the side condenser and a first amount of air is compressed in the main air compressor to a first outlet pressure, in a second operating mode a second amount of air, which is smaller than the first amount of air is compressed in the main air compressor, a second amount of the first liquid oxygen stream from the bottom of the low-pressure column, which is smaller than the first amount, is introduced into the side condenser, and a second liquid oxygen stream is fed to the side condenser in addition to the first liquid oxygen stream, characterized in that in both operating modes an intermediate liquid from an intermediate point of the low-pressure column is introduced into the evaporation space of the main condenser, and at least a portion of the vapor generated in the main condenser is introduced into the low-pressure column, an oxygen stream is removed from the lower region of the low-pressure column and passed into the evaporation space of an additional condenser which is in the form of a condenser-evaporator, at least a portion of the gas formed in the evaporation space of the additional condenser is introduced as rising vapor into the low-pressure column, the oxygen evaporated in the side condenser is heated in the main heat exchanger and obtained as the gaseous oxygen product, a first nitrogen stream from the distillation column system is compressed in a cold compressor and then introduced at least in part into the liquefaction space of the additional condenser, and at least a portion of the liquid nitrogen generated in the additional condenser is used as reflux in at least one of the columns of the distillation column system, wherein in the first operating mode a first amount of nitrogen is compressed in the cold compressor, a first amount of gaseous nitrogen from the high-pressure column is introduced into the main condenser, and the first amount of air is compressed in the main air compressor to a first total air pressure, and in the second operating mode a second amount of nitrogen, which is greater than the first amount of nitrogen, is compressed in the cold compressor, a second amount of gaseous nitrogen from the high-pressure column, which is smaller than the first amount, is introduced into the main condenser, and the second amount of air is compressed in the main air compressor to a second total air pressure which is lower than the first total air pressure.

In a departure from the conventional Linde double column, as is also used in Springmann, the main condenser is not configured as the bottom evaporator of the low-pressure column but as an intermediate evaporator. It can be arranged inside the low-pressure column or in a separate container. The bottom of the low-pressure column is heated by an additional condenser, which is heated by a cold-compressed nitrogen stream. The oxygen stream from the lower region of the low-pressure column, which is evaporated in the additional condenser, preferably comes from the lowermost layer of material exchange elements (packing or column plates), in which case the additional condenser is built into the container of the low-pressure column; alternatively, it can be drawn from the bottom of the low-pressure column, in particular when the additional condenser is arranged in a separate container. In both cases, the first liquid oxygen stream to the side condenser is preferably removed from the evaporation space of the additional condenser (which, in the case of an additional condenser built into the column, at the same time constitutes the bottom of the low-pressure column). All the condenser-evaporators can thereby be in the form of a bath evaporator, a falling-film evaporator or also a condenser-evaporator of a different type.

Such a condenser configuration is known per se from U.S. Pat. No. 6,626,008 B1 or US 2008115531 A1, but only for a process operated under steady-state conditions internal compression processes in which the evaporation of the liquid oxygen stream takes place in the main heat exchanger, in which the feed air is also cooled, and not in a separate side condenser. Although US 2008115531 A1 contains a reference to operation with variable energy consumption, only a small range of variation can be achieved with this process.

Firstly, the person skilled in the art would shy away from varying the first amount of nitrogen, which is compressed in the cold compressor, because this means variable operation of the additional condenser and thus of the distillation in the low-pressure column, which in principle makes a separation process less efficient and, under unfavorable circumstances, can greatly interfere with the material exchange in the column.

Only within the scope of the invention has it been found that it is possible, by varying the amount of nitrogen compressed in the cold compressor and used to heat the bottom of the low-pressure column, effectively to utilize not only the separative work contained in the liquid oxygen that is to be fed in, but also the cold contained therein (in order also to recover in part the outlay associated therewith in terms of liquefaction). This can be explained as follows: in the second operating mode, the evaporative capacity of the additional condenser is increased and that of the main condenser is correspondingly reduced. Increasing the evaporative capacity of the additional condenser increases the gas load and reduces the reflux ratio in the last (lower) section of the low-pressure column. This has the result that the oxygen content in the liquid to be evaporated in the main condenser falls and the pressure in the high-pressure column (which corresponds in principle to the outlet pressure of the main air compressor minus pressure losses) is correspondingly reduced. Because of the lower pressure ratio at the main air compressor—in addition to the reduction in the amount—a particularly large amount of energy per stored LOX amount can be saved in the second operating mode.

In US 2006115531 A1, on the other hand, neither the reflux ratio nor the evaporative capacity of the main condenser is influenced. Although the evaporative capacity of the side condenser is varied, this serves only for the evaporation of the liquid oxygen which may be fed in from outside and accordingly cannot reduce either the evaporative capacity of the main condenser or the operating pressure of the high-pressure column and thus the outlet pressure of the main air compressor.

Within the context of the invention, special regulation or adjustment measures for reducing the outlet pressure of the main air compressor are not necessarily required if the pressure between the outlet of the main air compressor and the inlet into the high-pressure column is not artificially reduced by one or more control elements such as, for example, a throttle valve. Within the context of a further embodiment of the invention, the first nitrogen stream is cooled downstream of the cold compressor and upstream of the liquefaction space of the additional condenser in the main heat exchanger. The heat of compression of the cold compressor is hereby reduced not in the additional evaporator but in the main heat exchanger. The additional evaporator accordingly works particularly efficiently, in particular in the second operating mode. Overall, even more energy can be saved in the second operating mode.

In addition, an expansion machine can be switched off or shut down in the second operating mode, in that in the first operating mode, a first turbine stream amount is expanded to perform work in an expansion machine and then heated in the main heat exchanger and/or introduced into the distillation column system, and in the second operating mode, the expansion machine is out of operation or a second turbine stream amount, which is smaller than the first turbine stream amount, is introduced into the expansion machine.

In the invention, in contrast to the method according to Springmann, preferably no liquid air is generated and stored in a liquid tank in the second operating mode. In addition, it is also advantageous if, in the second operating mode, no fraction from the distillation column system is generated as liquid nitrogen and stored in a liquid tank, as is the case in other conventional alternative reservoir processes.

According to a further embodiment of the invention, the air compressed in the main air compressor is branched, upstream of its introduction into the main heat exchanger, into a first and a second partial air stream, wherein the second partial air stream is compressed further in a booster air compressor and the further compressed second partial air stream is introduced into the liquefaction space of the side condenser and is there at least partially liquefied. The total air thereby needs to be compressed in the main air compressor only to the operating pressure of the high-pressure column plus line losses.

By using a booster air compressor, the gaseous oxygen product can be obtained under a pressure which is significantly higher than the operating pressure of the low-pressure column. However, the booster air compressor has a further advantageous effect in the invention, which occurs even if the oxygen product is obtained under a pressure that is not significantly higher than the low-pressure column pressure. Namely, it reduces the power of the cold compressor that is required to operate the additional condenser.

Branching of the feed air can be carried out upstream or downstream of a purification device for the air. In the first case, a purification device having sub-units for the two pressure levels is specifically required. A system for air purification that is particularly advantageous for use in a method according to the invention is described in WO 2013053425 A2, which belongs to the same applicant.

In the invention, a second nitrogen stream can be removed in gas form from the high-pressure column, heated in the main heat exchanger and removed in the form of a pressurized gaseous nitrogen product. Pressurized nitrogen can thereby be obtained as an additional gaseous product with a relatively low outlay.

Alternatively or in addition, nitrogen from the high-pressure column can be used in the first operating mode or in both operating modes for cold production, by removing a third nitrogen stream in gas form from the high-pressure column, heating it in the main heat exchanger to an intermediate temperature, and then expanding it to perform work, preferably in the variably operated expansion turbine mentioned above. Instead, it is also possible to generate cold in an air-injection turbine, in which a portion of the feed air is expanded to low-pressure column pressure to perform work and fed directly into the low-pressure column.

The low-pressure column and the high-pressure column can in principle be arranged next to one another. A particularly compact arrangement is obtained in the invention if the low-pressure column and the high-pressure column are arranged one above the other, that is to say form a conventional double column. The main condenser and the additional condenser are preferably built into the double column by arranging the low-pressure column and the two condensers in a common container.

In particular when the columns are arranged one above the other, it is advantageous if at least a portion, in particular the totality, of the reflux liquid which is fed in at the head of the low-pressure column is formed by a portion of the liquid nitrogen generated in the additional condenser. This has a higher pressure than the nitrogen formed in the main condenser and is therefore able to flow to the head of the low-pressure column without a pump. Only a single cryogenic process pump is then preferably required, namely for transporting the high-pressure column bottom liquid to the appropriate feed point at the low-pressure column, despite the arrangement of the columns above one another. (A pump which may be used for increasing the pressure of the liquid oxygen upstream of the side condenser is not included in the "process pumps".)

The invention additionally relates to a device for oxygen production by low-temperature separation of air with variable energy consumption, having

- a distillation column system having a high-pressure column, a low-pressure column as well as a main condenser and a side condenser which are both in the form of condenser-evaporators,
- having a main air compressor for compressing atmospheric air,
- having a main heat exchanger for cooling the compressed air,
- having means for introducing the cooled air into the high-pressure column,
- having means for introducing gaseous nitrogen from the high-pressure column into the liquefaction space of the main condenser,
- having means for introducing the liquid nitrogen generated in the main condenser as reflux into at least one of the columns of the distillation column system,
- having means for introducing a first liquid oxygen stream from the bottom of the low-pressure column into the evaporation space of the side condenser,
- having means for introducing compressed and cooled feed air into the liquefaction space of the side condenser,
- having means for obtaining at least a portion of the evaporated first liquid oxygen stream as a gaseous oxygen product,
- and having means for switching between a first and a second operating mode wherein
- in a first operating mode with higher energy consumption
- a first amount of the first liquid oxygen stream from the bottom of the low-pressure column is introduced into the side condenser, and
- a first amount of air is compressed in the main air compressor,
- in a second operating mode with lower energy consumption
- a second amount of air, which is smaller than the first amount of air, is compressed in the main air compressor,
- a second amount of the first liquid oxygen stream from the bottom of the low-pressure column, which is smaller than the first amount, is introduced into the side condenser,
- a second liquid oxygen stream is fed to the side condenser in addition to the first liquid oxygen stream, characterized by

- means for introducing an intermediate liquid from an intermediate point of the low-pressure column into the evaporation space of the main condenser,
- means for introducing the vapor generated in the main condenser into the low-pressure column,
- an additional condenser which is in the form of a condenser-evaporator,
- means for introducing an oxygen stream from the lower region of the low-pressure column into the evaporation space of the additional condenser,
- means for introducing at least a portion of the gas formed in the evaporation space of the additional condenser into the low-pressure column as rising vapor,
- means for introducing the oxygen evaporated in the side condenser into the main heat exchanger,
- means for obtaining the oxygen heated in the main heat exchanger as the gaseous oxygen product,
- a cold compressor for compressing a first nitrogen stream from the distillation column system,
- means for introducing at least a portion of the nitrogen compressed in the cold compressor into the liquefaction space of the additional condenser, and
- means for introducing at least a portion of the liquid nitrogen generated in the additional condenser into at least one of the columns of the distillation system as reflux, and in that the means for switching are so designed that in the first operating mode

- a first amount of nitrogen is compressed in the cold compressor,
- a first amount of gaseous nitrogen from the high-pressure column is introduced into the main condenser, and
- the first amount of air is compressed in the main air compressor to a first total air pressure, and in the second operating mode

- a second amount of nitrogen, which is larger than the first amount of nitrogen, is compressed in the cold compressor,
- a second amount of gaseous nitrogen from the high-pressure column, which is smaller than the first amount, is introduced into the main condenser, and
- the second amount of air is compressed in the main air compressor to a second total air pressure which is lower than the first total air pressure. The device according to the invention can be supplemented by device features which correspond to the features of the dependent method claims.

The "means for switching between a first and a second operating mode" are complex regulating and control devices which, when used together, permit at least partially automatic switching between the two operating modes, for example by a correspondingly programmed operational control system.

BRIEF DESCRIPTION OF THE DRAWINGS

The invention and further details of the invention will be described in greater detail below by means of embodiments shown schematically in the drawings, in which:

FIG. 4 shows a fourth embodiment with columns arranged side by side and switching of a group of passages of the main heat exchanger.

DETAILED DESCRIPTION OF THE INVENTION

Figure 1:
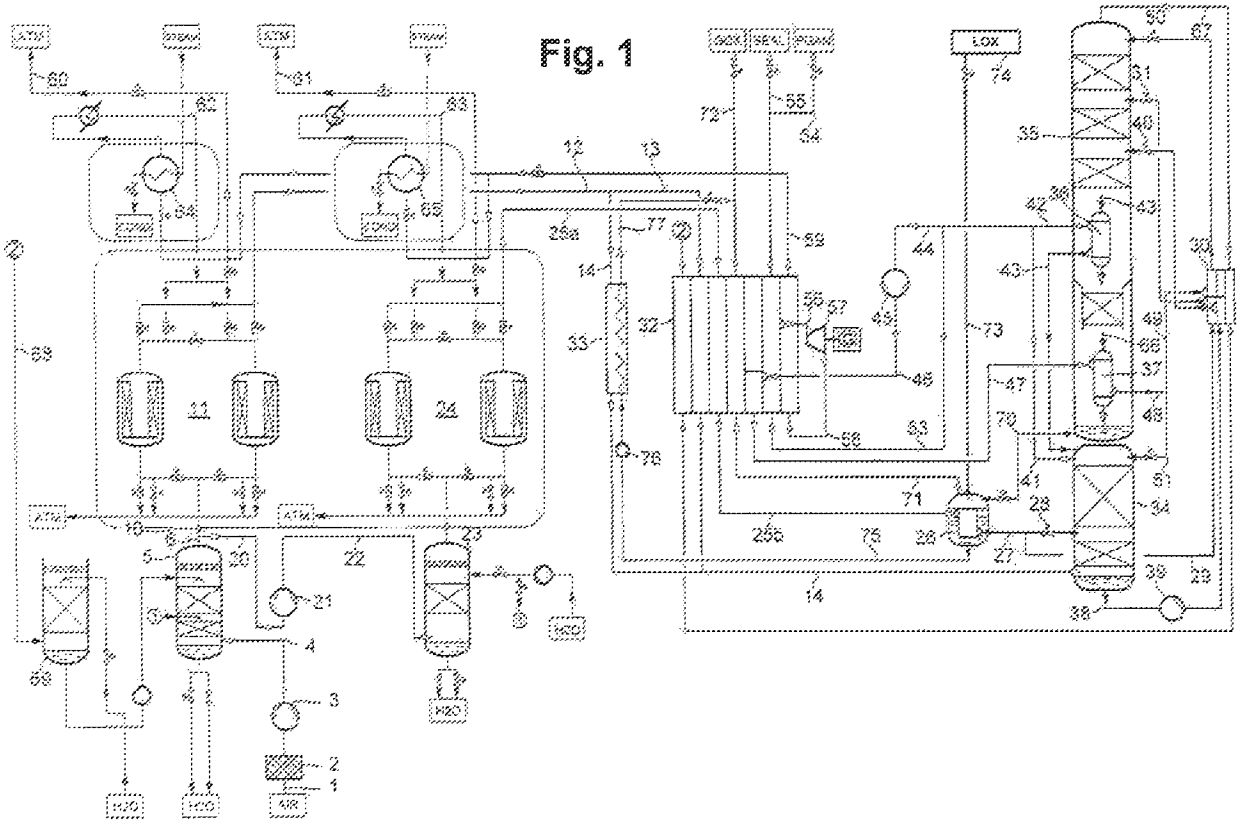
FIG. 1 shows a first embodiment of the invention with pressurized nitrogen production.

The method of FIG. 1 is first described below with reference to the first operating mode (here: normal operation when the energy price is relatively low). Atmospheric air 1 (AIR) is drawn via a filter 2 from a main air compressor (MAC) 3 and compressed to a pressure of 3.6 bar, for example. The total air stream 4 compressed in the main air compressor is precooled in a first direct contact cooler 5 by means of direct countercurrent with water. Downstream of the first direct contact cooler 5, the total air stream 6 is branched into a first partial air stream 10 and a second partial air stream 20.

The first partial air stream 10 is purified in a first purifying unit 11 and fed via line 12, at the outlet pressure of the main air compressor minus line losses, to the hot end of a main heat exchanger. The main heat exchanger is formed in the example by two sections 32, 33 which are connected in parallel on the air side and are preferably both formed by plate heat exchanger blocks. The largest portion 13 of the purified first partial stream 12 is fed to the first section 32, cooled there to approximately dew point and passed via line 14 to the high-pressure column 34 of a distillation column system. The distillation column system additionally has a low-pressure column 35 as well as three condenser-evaporators, namely a main condenser 36, an additional condenser 37 and a side condenser 26. The main and additional condensers are in the form of falling-film evaporators, and the side condenser is in the form of a bath evaporator. In the example, the operating pressure of the high-pressure column 34 is approximately 3.27 bar, that of the low-pressure column 35 is approximately 1.23 bar (in each case at the head).

The second partial air stream 20 comprises approximately a quarter of the total air amount 6 and is further compressed in a booster air compressor (BAC) 21 to 5.1 bar, for example. The further compressed second partial air stream 22 is precooled with water in a second direct contact cooler 23 by direct countercurrent with water. Downstream of the second direct contact cooler 23, the precooled second partial air stream is purified in a second purifying unit 24. The purified second partial air stream 25*a* is fed, at the outlet pressure of the booster air compressor 21 minus line losses, to the hot end of the main heat exchanger 32, where it is cooled. The cooled second partial stream 25*b* is liquefied at least partially, preferably completely or substantially completely, in the side condenser 26 and a first portion is introduced at an intermediate point via a throttle valve 28 of the high-pressure column 34. A second portion 29 flows through a supercooling countercurrent heat exchanger 30 and is fed in at an intermediate point via throttle valve 31 of the low-pressure column 35.

An oxygen-enriched bottom fraction 38 is removed in liquid form from the lower region of the high-pressure column 34 and fed by means of a pump 39 through a supercooling countercurrent heat exchanger 30 and via throttle valve 40 into the low-pressure column 35.

Gaseous nitrogen is drawn off at the head of the high-pressure column 34 via line 41. A first portion 42 thereof is fed into the liquefaction space of the main condenser 36, where it is liquefied at least partially against an evaporating intermediate fraction 43 from the low-pressure column 35. The liquid nitrogen 43 thereby generated is fed back to the head of the high-pressure column 34, where it is used as reflux.

A second portion of the gaseous nitrogen 41 from the head of the high-pressure column 34 is compressed as the "first nitrogen stream" 44 in a cold compressor 45 to approximately 4.8 bar. The cold-compressed first nitrogen stream 46 is cooled to approximately dew point again in the main heat exchanger 32 and fed via line 47 into the liquefaction space of the additional condenser 37, where it is at least partially liquefied in indirect heat exchange with partially evaporating bottom liquid 66 of the low-pressure column 35. A first portion 49 of the liquid nitrogen 43 thereby generated is applied through the supercooling countercurrent heat exchanger 30 and via throttle valve 50 as reflux to the head of the low-pressure column 35; a second portion 51 thereof is applied as reflux to the high-pressure column 34.

A third portion of the gaseous nitrogen 41 from the head of the high-pressure column 34 is passed via line 53 to the cold end of the main heat exchanger 32. A portion thereof is heated to ambient temperature and drawn off via line 54 as the "second nitrogen stream" and discharged as pressurized gaseous nitrogen product (PGAN). Another portion 55 is likewise heated completely and used within the plant for auxiliary purposes, for example as compressed gas. (The production of such a pressurized nitrogen product and/or of a nitrogen auxiliary gas is possible but not necessary in all embodiments of the invention. The same also applies to the systems of FIGS. 2 and 3.)

A further portion 56 of the gaseous nitrogen 41 from the head of the high-pressure column 34 is branched off in the main heat exchanger 32 at an intermediate temperature as the "third nitrogen stream" and is expanded to just above atmospheric pressure in an expansion machine 57, which is in the form of a cold generator turbine. The third nitrogen stream 58 expanded to perform work is heated in the main heat exchanger 32 to approximately ambient temperature. If the hot third nitrogen stream 59 is not discharged directly into the atmosphere (ATM) via lines 60 and 61, it is used in the purifying devices 11, 24 as regenerating gas 62, 63, optionally after heating in one of the regenerating gas heaters 64, 65, which are operated with condensing steam (STEAM).

Residual gas 67 from the head of the low-pressure column is heated in the supercooling countercurrent heat exchanger 30 and in the main heat exchanger 32 and finally fed via line 68 as dry gas into an evaporative cooler, which serves to cool cooling water.

Liquid oxygen as the "first liquid oxygen stream" is fed via line 70, under a pressure of approximately 1.5 bar, into the evaporation space of the side condenser 26, where it is evaporated almost completely. The evaporated oxygen 71 is heated in the main heat exchanger 32 and obtained via line 72 as gaseous oxygen product (GOX). Rinse liquid 75 from the evaporation space of the side condenser 26 is brought to a supercritical pressure in a pump 76 and pseudo-evaporated and heated in section 33 of the main heat exchanger against the air stream 14. The heated stream is then throttled and mixed with the hot gaseous oxygen product, so that only a single oxygen product is supplied.

In the first operating mode, there is no flow through the line 73 from a liquid oxygen tank 74 to the evaporation space of the side condenser 26.

In the second operating mode, on the other hand, liquid oxygen from a liquid tank 74 is introduced into the side condenser via line 73 as the "second liquid oxygen stream". In addition, the following process parameters are changed compared with the first operating mode, as follows:

The capacity of the cold compressor 45 is increased from 70% to 100%. (The amount of nitrogen compressed in the cold compressor thereby increases by only approximately 8%. The significantly greater increase in capacity arises because the intake pressure of the cold compressor is reduced according to the operating pressure of the high-pressure column.)

The capacity of the main air compressor falls to approximately 80%.

The total air pressure at the outlet of the main air compressor 3 is reduced by approximately 14%, for example from approximately 3.65 bar to approximately 3.15 bar.

The capacity of the booster air compressor 21 is increased from approximately 80% to 100%.

The capacity of the cold compressor 45 is increased from approximately 70% to 100%.

The amount of nitrogen through the expansion turbine 57 is reduced from 100% to 0% (that is to say, the expansion turbine is out of operation in the second operating mode).

If in a variant embodiment a plurality of parallel cold compressors (e.g. two) are used at the same location, it is possible to proceed even more efficiently. The second cold compressor is switched on in the second operating mode, so that twice the capacity is then available. The main air compressor can in this case operate at minimal load, and the smaller booster air compressor can operate at its maximum. Because about 90% of the total energy consumption is required for driving the main air compressor, the process becomes more efficient, the further the capacity of the main air compressor can be reduced, even if the capacity of the cold compressor is thereby increased.

(In a departure from the embodiment shown here, the plant can be designed for maximum oxygen production, which is higher than that of the first or second operating mode, that is to say a smaller amount of gaseous oxygen product 72 than the design case is obtained in the first and/or second operating mode. The method of the invention is here flexible, as long as the operating ranges of the machines used are not exceeded.)

It is generally advantageous in the invention if the cold compressor is operated in the first operating mode with as low a capacity as possible, but the main air compressor is so designed that it runs at approximately 100% of its nominal capacity in the first operating mode. The booster air compressor and the nitrogen cold compressor, on the other hand, are designed, for example, for the capacity that is required in the second operating case.

By means of these measures, the total energy consumed in the process is reduced in the second operating mode to approximately 86% of the value in the first operating mode, despite the production of gaseous nitrogen 72 being equivalent or only slightly lower. The corresponding margin is available for energy storage if the supply of liquid oxygen is sufficient.

Figure 2:
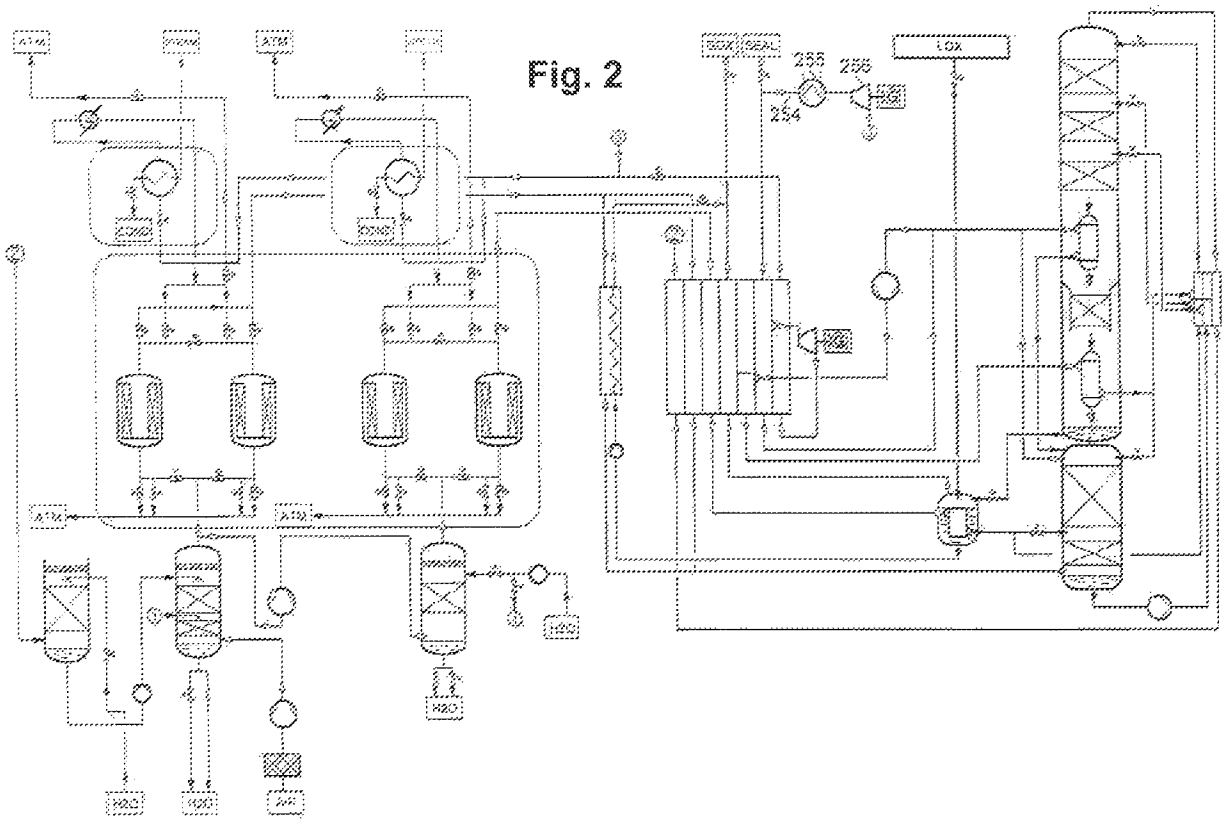
FIG. 2 shows a modification of the first embodiment in which the pressurized nitrogen is at least intermittently expanded to perform work in a hot turbine (hot gas expander).

FIG. 2 differs from FIG. 1 in that no pressurized gaseous nitrogen product is generated. Instead, in the second operating mode, nitrogen product 254 obtained directly from the high-pressure column is brought to significantly above ambient temperature in a heater 255 and expanded to perform work in a hot expansion turbine (hot gas expander) 256. As a result, with the aid of residual heat coupled into the heater 255, particularly valuable electrical energy can be obtained in times of high energy prices in a generator coupled to the expansion turbine 256. If waste heat (for example from low-pressure vapor) which otherwise cannot be used economically is used for the heater 255, a total reduction of approximately 76% in the energy required for the air separation process is in this case achieved in the second operating mode as compared with the first.

In an embodiment which is modified in relation to FIG. 2, a portion of the nitrogen removed directly from the high-pressure column is used in the first operating mode to generate pressurized gaseous nitrogen product (see PGAN in FIG. 1), at least in the first operating mode, optionally also in the second operating mode.

Figure 3:
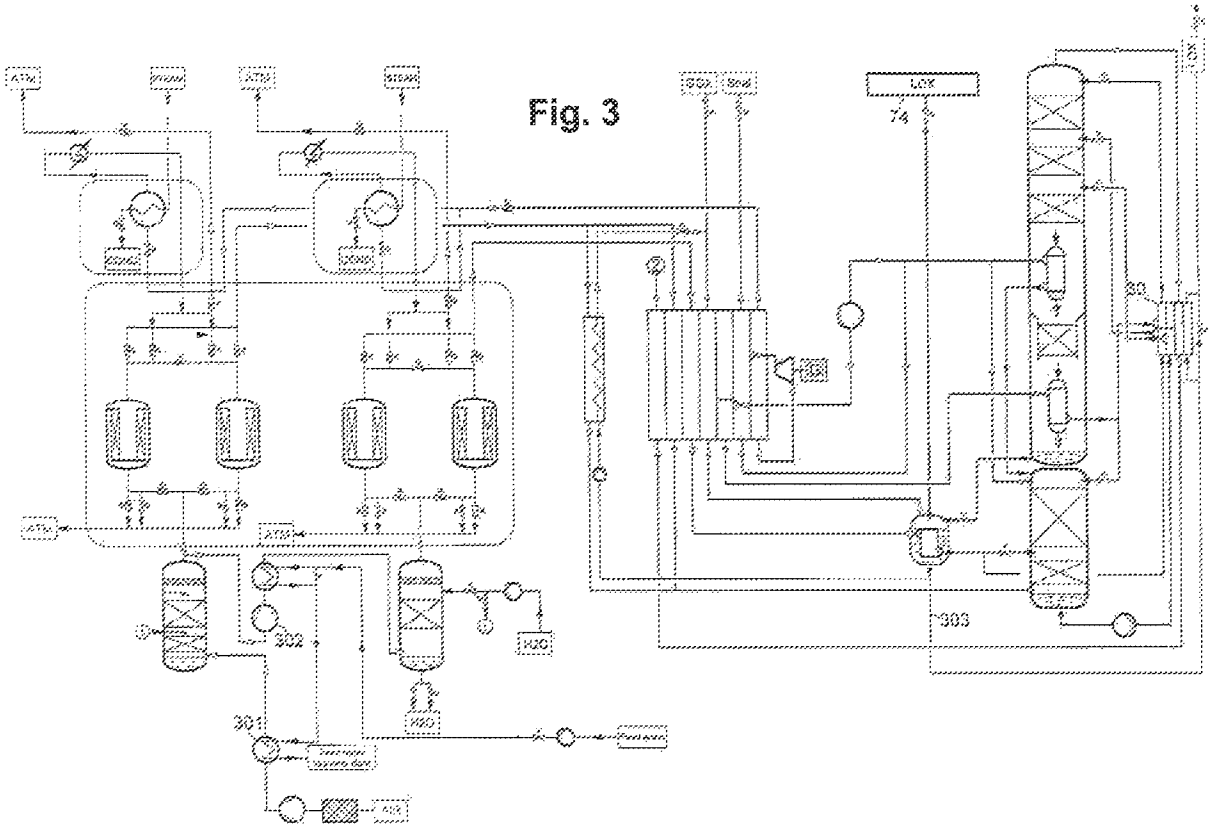
FIG. 3 shows a further embodiment with heat integration.

The method of FIG. 3 differs from that of FIG. 1 by a heat integration between the compressor cooling and a steam circuit belonging, for example, to a power plant. Via the additional coolers 301 and 302 upstream of the two direct contact coolers, heat of compression from the air compression is transferred to feed water for the power plant process (feed water to power plant).

FIG. 3 additionally shows how the portion of the first liquid oxygen stream that is not evaporated in the side condenser is in the first operating mode drawn off in part via line 303, optionally cooled in the supercooling countercurrent heat exchanger 30 and discharged as liquid oxygen product (LOX). This liquid oxygen product can be introduced wholly or in part into the liquid tank 74. In all the other embodiments of the invention too (for example according to FIG. 1 or 2), liquid oxygen can be obtained in this manner in the first operating mode, which liquid oxygen later forms a portion or the totality of the liquid oxygen that is fed in via line 73 in the second operating mode.

In the system of FIG. 4, the high-pressure column 34 and the low-pressure column 35 are arranged side by side. In addition, the additional condenser 37 (the bottom heating of the low-pressure column 35) is positioned above the high-pressure column 34. In the specific example, the side condenser 26 is situated between the high-pressure column 34 and the additional condenser 37.

FIG. 4 additionally shows a portion of the heat integration, already shown in FIG. 3, between the compressor cooling and a steam circuit, namely a cooler 301, which is operated with feed water from the power plant process.

In FIG. 4, this heat integration is combined with a hot expansion turbine (hot gas expander) 256, as is explained in detail in FIG. 2. A line 401 with a relief valve is additionally provided.

In contrast to FIG. 2, no separate heat exchanger passages are required in the main heat exchanger 32*a*, 32*b* for the stream 447, 453, 454 in the method of FIG. 3. Rather, in alternating operation, that stream is passed through the same group of passages as the turbine-expanded stream 58. To that end, the valve 402 is in the first operating mode, while the valve 403 is closed. Conversely, in the second operating mode, the turbine 57 is still, the valve 402 is closed and the valve 403 is open. This results in a particularly compact construction of the main heat exchanger 32*a*, 32*b*.

All the other features of FIG. 4 are described in FIGS. 1 and 3.

What we claim is:

1. A method for oxygen production by low-temperature separation of air with variable energy consumption in a distillation column system having a high-pressure column, a low-pressure column as well as a main condenser and a side condenser which are both in the form of condenser-evaporators, wherein in the method atmospheric air is compressed to a total air pressure in a main air compressor, cooled in a main heat exchanger and fed at least in part to the high-pressure column, in the main condenser, gaseous nitrogen from the high-pressure column is at least partially liquefied, at least a portion of the liquid nitrogen generated in the main condenser is used as reflux in at least one of the columns of the distillation column system, a first liquid oxygen stream from the bottom of the low-pressure column is introduced into the side condenser and is at least partially evaporated therein in indirect heat exchange with at least a portion of the compressed and cooled feed air, at least a portion of the evaporated first liquid oxygen stream is obtained as a gaseous oxygen product, in a first operating mode with a first energy consumption a first amount of the first liquid oxygen stream from the bottom of the low-pressure column is introduced into the side condenser and a first amount of air is compressed in the main air compressor to a first outlet pressure, in a second operating mode with a second energy consumption lower than the first energy consumption a second amount of air, which is smaller than the first amount of air, is compressed in the main air compressor, a second amount of the first liquid oxygen stream from the bottom of the low-pressure column, which is smaller than the first amount of the first liquid oxygen from the bottom of the low-pressure column, is introduced into the side condenser, and a second liquid oxygen stream is fed to the side condenser in addition to the first liquid oxygen stream, characterized in that in both operating modes an intermediate liquid from an intermediate point of the low-pressure column is introduced into an evaporation space of the main condenser, and at least a portion of the vapor generated in the main condenser is introduced into the low-pressure column, an oxygen stream is removed from a lower region of the low-pressure column and passed into an evaporation space of an additional condenser which is in the form of a condenser-evaporator, at least a portion of the gas formed in the evaporation space of the additional condenser is introduced as rising vapor into the low-pressure column, the oxygen evaporated in the side condenser is heated in the main heat exchanger and obtained as the gaseous oxygen product, a first nitrogen stream from the distillation column system is compressed in a cold compressor and then introduced at least in part into a liquefaction space of the additional condenser, and at least a portion of the liquid nitrogen generated in the additional condenser is used as reflux in at least one of the columns of the distillation column system, wherein in the first operating mode a first amount of nitrogen is compressed in the cold compressor, a first amount of gaseous nitrogen from the high-pressure column is introduced into the main condenser, and the first amount of air is compressed in the main air compressor to a first total air pressure, and in the second operating mode a second amount of nitrogen, which is greater than the first amount of nitrogen, is compressed in the cold compressor, a second amount of gaseous nitrogen from the high-pressure column, which is smaller than the first amount of gaseous nitrogen, is introduced into the main condenser, and the second amount of air is compressed in the main air compressor to a second total air pressure which is lower than the first total air pressure.

2. The method as claimed in claim 1, characterized in that the first stream of nitrogen is cooled in the main heat exchanger downstream of the cold compressor and upstream of the liquefaction space of the additional condenser.

3. The method as claimed in claim 1, characterized in that in the first operating mode, a first turbine stream amount is expanded to perform work in an expansion machine and then heated in the main heat exchanger and/or introduced into the distillation column system, and in the second operating mode, the expansion machine is out of operation or a second turbine stream amount, which is smaller than the first turbine stream amount, is introduced into the expansion machine.

4. The method as claimed in claim 1, characterized in that, in the second operating mode, no liquid air is generated and stored in a liquid tank.

5. The method as claimed in claim 1, characterized in that, in the second operating mode, no fraction is discharged from the distillation column system as liquid nitrogen and stored in a liquid tank.

6. The method as claimed in claim 1, characterized in that the air compressed in the main air compressor is branched upstream of the compressed airs introduction into the main heat exchanger into a first and a second partial air stream, wherein the second partial air stream is compressed further in a booster air compressor and the further compressed second partial air stream is introduced at least in part into a liquefaction space of the side condenser and is there at least partially liquefied.

7. The method as claimed in claim 1, characterized in that a second nitrogen stream is removed in gas form from the high-pressure column, heated in the main heat exchanger and removed as pressurized gaseous nitrogen product.

8. The method as claimed in claim 1, characterized in that a third nitrogen stream is removed in gas form from the high-pressure column, heated to an intermediate temperature in the main heat exchanger and then expanded to perform work.

9. The method as claimed in claim 1, characterized in that the low-pressure column and the high-pressure column are arranged one above the other.

10. The method as claimed in claim 1, characterized in that at least a portion of the reflux liquid which is fed in at a head of the low-pressure column is formed by a portion of the liquid nitrogen generated in the additional condenser.

11. The method as claimed in claim 10, characterized in that the totality of the reflux liquid which is fed in at the head of the low-pressure column is formed by a portion of the liquid nitrogen generated in the additional condenser.

* * * * *